US007475566B2

(12) United States Patent
Schroeder et al.

(10) Patent No.: US 7,475,566 B2
(45) **Date of Patent: *Jan. 13, 2009**

(54) LIQUID NATURAL GAS PROCESSING

(75) Inventors: Scott Schroeder, Houston, TX (US); Kenneth Reddick, Houston, TX (US); Noureddine Belhateche, Houston, TX (US)

(73) Assignee: Howe-Barker Engineers, Ltd., Tyler, TX (US)

( * ) Notice: Subject to any disclaimer, the term of this patent is extended or adjusted under 35 U.S.C. 154(b) by 390 days.

This patent is subject to a terminal disclaimer.

(21) Appl. No.: 11/188,961

(22) Filed: Jul. 25, 2005

(65) Prior Publication Data

US 2006/0260356 A1 Nov. 23, 2006

Related U.S. Application Data

(63) Continuation-in-part of application No. 10/115,150, filed on Apr. 3, 2002, now Pat. No. 6,941,771.

(51) Int. Cl.
*F25J 1/00* (2006.01)
*F25J 3/00* (2006.01)

(52) U.S. Cl. ..... 62/614; 62/620; 62/630

(58) Field of Classification Search ..... 62/613, 62/614, 620, 630

See application file for complete search history.

(56) References Cited

U.S. PATENT DOCUMENTS 3,261,169 A 7/1966 Harmens
3,405,530 A 10/1968 Denahan et al.
3,420,068 A 1/1969 Petit
3,656,312 A * 4/1972 Streich ..... 62/630
3,837,172 A 9/1974 Markbreiter et al.
3,837,821 A 9/1974 Buffiere et al.
5,114,451 A 5/1992 Rambo et al.
5,402,645 A 4/1995 Johnson et al.
5,561,988 A 10/1996 Mehra
5,588,308 A 12/1996 Daugherty et al.
5,687,584 A 11/1997 Mehra
5,953,935 A 9/1999 Sorensen
6,564,579 B1 5/2003 McCartney
6,604,380 B1 8/2003 Reddick et al.
6,907,752 B2 * 6/2005 Schroeder et al. ..... 62/620
6,941,771 B2 9/2005 Reddick et al.
6,964,181 B1 * 11/2005 Milios et al. ..... 62/620

(Continued)

FOREIGN PATENT DOCUMENTS

WO WO 03/085341 A1 10/2003

OTHER PUBLICATIONS

International Search Report for International Application No. PCT/US 03/09948.

(Continued)

*Primary Examiner*—William C Doerrler
(74) *Attorney, Agent, or Firm*—McDonnell, Boehnen Hulbert & Berghoff LLP

(57) ABSTRACT

A process for the recovery of natural gas liquids (NGL) from liquefied natural gas (LNG) is disclosed. The LNG feed stream is subjected to a two stage separation process where the bottoms from the first stage separation containing $C_2$+ hydrocarbons is split into two portions, with one portion being heated and used as a reflux during the second stage separation to recover the NGL product.

3 Claims, 1 Drawing Sheet

U.S. PATENT DOCUMENTS

| | | | | |
|---|---|---|---|---|
| 7,204,100 | B2 * | 4/2007 | Wilkinson et al. | ..... 62/612 |
| 2002/0029585 | A1 | 3/2002 | Stone et al. | |
| 2005/0005636 | A1 | 1/2005 | Schroeder et al. | |
| 2006/0000234 | A1 | 1/2006 | Cuellar et al. | |
| 2006/0130521 | A1 | 6/2006 | Patel | |

OTHER PUBLICATIONS

International Search Report for International Application No. PCT/US03/09942.
International Search Report for PCT Application No. PCT/US2006/028822.

* cited by examiner

100
DEETHANIZER
RECOVERY
NGL
LNG
LNG
1
2
3
4
5
6
7
8
9
10
11
12
13
14
15
16
17
18
19
27
30
31
32
33

LIQUID NATURAL GAS PROCESSING

RELATED APPLICATIONS

This application is a continuation-in-part application of application U.S. Ser. No. 10/115,150, filed Apr. 3, 2002 now U.S. Pat. No. 6,941,771.

FIELD OF THE INVENTION

The present invention is directed toward the recovery of hydrocarbons heavier than methane from liquefied natural gas (LNG) and in particular to a two step separation process where the $C_2$+ hydrocarbons recovered in the first separation stage are split and a portion is heated before entering the second separation stage to aid in the recovery of the heavier than methane hydrocarbons.

BACKGROUND OF THE INVENTION

Natural gas typically contains up to 15 vol. % of hydrocarbons heavier than methane. Thus, natural gas is typically separated to provide a pipeline quality gaseous fraction and a less volatile liquid hydrocarbon fraction. These valuable natural gas liquids (NGL) are comprised of ethane, propane, butane, and minor amounts of other heavy hydrocarbons. In some circumstances, as an alternative to transportation in pipelines, natural gas at remote locations is liquefied and transported in special LNG tankers to appropriate LNG handling and storage terminals. The LNG can then be revaporized and used as a gaseous fuel in the same fashion as natural gas. Because the LNG is comprised of at least 80 mole percent methane it is often necessary to separate the methane from the heavier natural gas hydrocarbons to conform to pipeline specifications for heating value. In addition, it is desirable to recover the NGL because its components have a higher value as liquid products, where they are used as petrochemical feedstocks, compared to their value as fuel gas.

NGL is typically recovered from LNG streams by many well-known processes including "lean oil" adsorption, refrigerated "lean oil" absorption, and condensation at cryogenic temperatures. Although there are many known processes, there is always a compromise between high recovery and process simplicity (i.e., low capital investment). The most common process for recovering NGL from LNG is to pump and vaporize the LNG, and then redirect the resultant gaseous fluid to a typical industry standard turbo-expansion type cyrogenic NGL recovery process. Such a process requires a large pressure drop across the turbo-expander or J. T. valve to generate cryogenic temperatures. In addition, such prior processes typically require that the resultant gaseous fluid, after LPG extraction, be compressed to attain the pre-expansion step pressure. Alternatives to this standard process are known and two such processes are disclosed in U.S. Pat. Nos. 5,588,308 and 5,114,457. The NGL recovery process described in the '308 patent uses autorefrigeration and integrated heat exchange instead of external refrigeration or feed turbo-expanders. This process, however, requires that the LNG feed be at ambient temperature and be pretreated to remove water, acid gases and other impurities. The process described in the '457 patent recovers NGL from a LNG feed that has been warmed by heat exchange with a compressed recycle portion of the fractionation overhead. The balance of the overhead, comprised of methane-rich residual gas, is compressed and heated for introduction into pipeline distribution systems.

The present invention provides another alternative NGL recovery process that produces a low-pressure, liquid methane-rich stream that can be directed to the main LNG export pumps where it can be pumped to pipeline pressures and eventually routed to the main LNG vaporizers. Moreover, our invention uses a two step separation process where the $C_2$+ hydrocarbons recovered in the first separation stage are split and a portion is heated before entering the second separation stage to aid in the recovery of the heavier than methane hydrocarbons as described in the specification below and defined in the claims which follow.

SUMMARY OF THE INVENTION

As stated, our invention is directed to an improved process for the recovery of NGL from LNG which avoids the need for dehydration, the removal of acid gases and other impurities. A further advantage of our process is that it significantly reduces the overall energy and fuel requirements because the residue gas compression requirements associated with a typical NGL recovery facility are virtually eliminated. Our process also does not require a large pressure drop across a turbo-expander or J. T. value to generate cryogenic temperatures. This reduces the capital investment to construct our process by 30 to 50% compared to a typical cryogenic NGL recovery facility.

In general, our process recovers hydrocarbons heavier than methane using low pressure liquefied natural gas (for example, directly from an LNG storage system) by using a two step separation process where the $C_2$+ hydrocarbons recovered in the first separation (recovery) stage are split and a portion is heated before entering the second separation stage and the other portion is used as a reflux stream in the second separation step. This aids in the recovery of the heavier than methane hydrocarbons, thus producing high yields of NGL. The $C_1$-$C_2$ rich stream recovered overhead in the second separation step is recycled to the first separation step to produce a methane-rich stream. This methane-rich stream from the first separation step is routed to the suction side of a low temperature, low head compressor to re-liquefy the methane-rich stream. This re-liquefied LNG is then split, with a portion being used as the second reflux in the first separation stage and the remaining portion directed to main LNG export pumps.

DETAILED DESCRIPTION OF THE INVENTION

Figure 1:
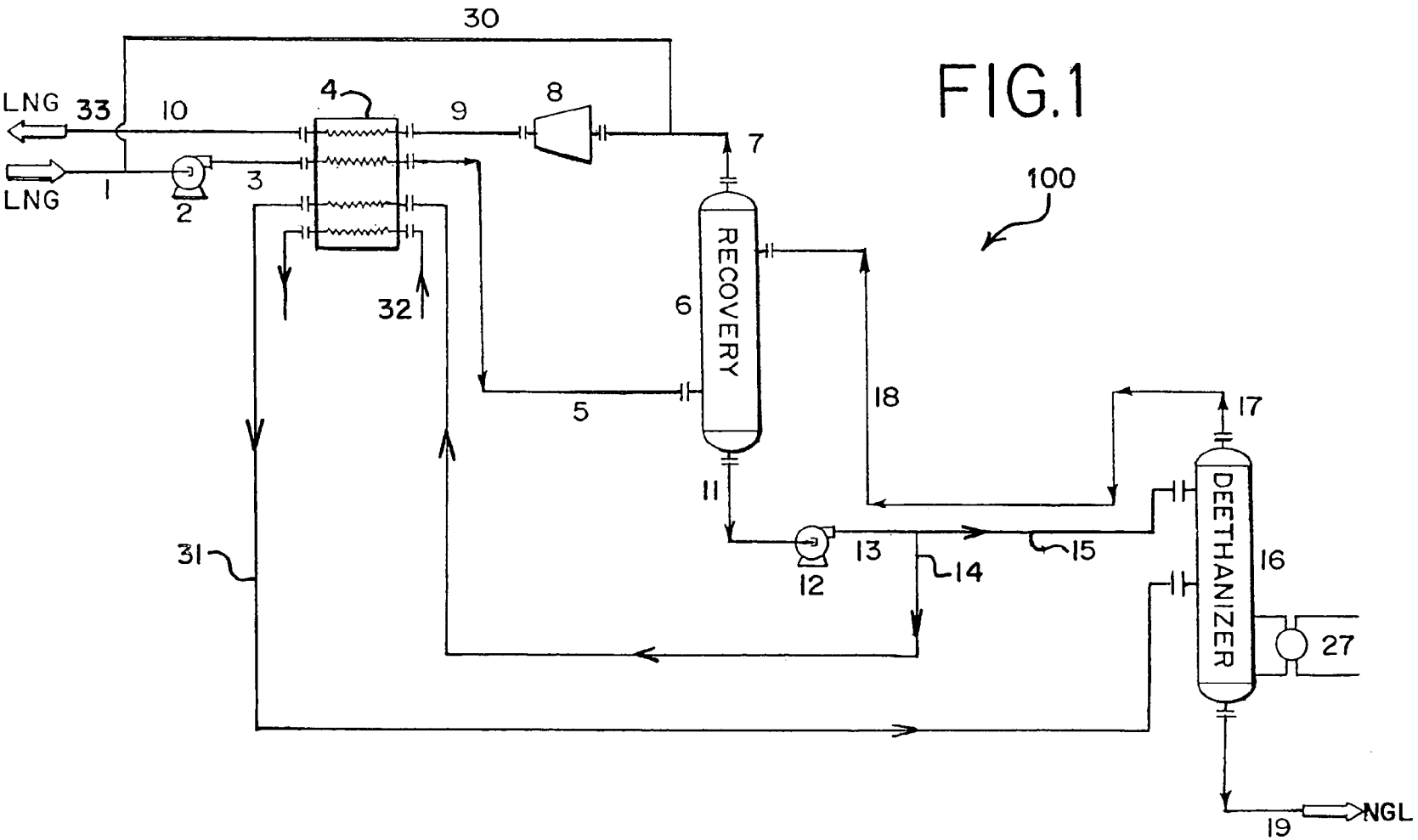
FIG. 1 is a schematic flow diagram of one embodiment of the present invention.

Natural gas liquids (NGL) are recovered from low-pressure liquefied natural gas (LNG) without the need for external refrigeration or feed turboexpanders as used in prior processes. Referring to FIG. 1, process 100 shows the incoming LNG feed stream 1 enters pump 2 at very low pressures, typically in the range of 0-5 psig and at a temperature of less than −200° F. Pump 2 may be any pump design typically used for pumping LNG provided that it is capable of increasing the pressure of the LNG several hundred pounds to approximately 100-500 psig, preferably the process range of 300-350 psig. The resultant stream 3 from pump 2 is physically fed to cold box 4 where it is cross-exchanged with substantially NGL-free residue gas in line 9 obtained from the discharge of compressor 8. In those circumstances where additional cooling is necessary in cold box 4, an external refrigerant line 32 may be employed to increase the cooling capacity. Although the exact nature of the external refrigerant is not critical to the invention, a high pressure LNG stream may be the most convenient to use. The heated stream of the LNG feed is removed from cold box 4 as stream 5.

After being warmed and partially vaporized, the LNG in stream 5 can be further warmed, if needed during process start-up, with an optional heat exchanger (not shown) and then fed to the first separator or recovery tower 6. Separator 6 may be comprised of a single separation process or a series flow arrangement of several unit operations routinely used to separate fractions of LNG feedstocks. The internal configuration of the particular separator(s) used is a matter of routine engineering design and is not critical to our invention. Stream 5 is separated in separator 6 into an NGL rich bottom stream 11 which is removed via pump 12 and stream 13. Stream 13 is split into two portions to create streams 14 and 15. The relative portions of streams 14 and 15 are dependent on the amount of ethane recovery desired and the composition of the feed LNG. A preferred split would be 15-85% in stream 14 and 15-85% in stream 15. Stream 14 is eventually heated before being routed via line 31 as feed to deethanizer 16. A preferred method of heating stream 14 is to return it to cold box 4 where it is cross-heat exchanged with compressed LNG from stream 9. Stream 15 is used directly as a reflux stream in deethanizer 16 to increase the recovery of the desired heavy components. Deethanizer 16 may be heated by a bottom reboiler or a side reboiler 27.

A methane-rich overhead stream 17 is removed from deethanizer 16 and routed to the recovery tower 6. Routing this stream back to recovery tower allows any ethane and heavy components in this stream to be recovered. A recovered NGL product stream 19 is removed from deethanizer 16 and routed to NGL storage or pumped to an NGL pipeline or fractionator (not shown). A methane-rich overhead stream 7, substantially free of NGL, is removed from separator 6 and fed to a low temperature, low head compressor 8 where it forms compressed LNG stream 9. Compressor 8 is needed to provide enough boost in pressure so that exiting stream 9 maintains an adequate temperature difference in the main gas heat exchanger (cold box) 4 to form re-liquefied methane-rich gas (LNG) exit stream 10. Compressor 8 is designed to achieve a marginal pressure increase of about 75 to 115 psi, preferably increasing the pressure from about 300 psig to about 350-425 psig. The re-liquefied methane-rich (LNG) in stream 10 is split into two portions forming stream 30 and 33. Stream 30 is used as an external reflux to separator 6. This reflux is necessary to achieve very high levels of ethane recovery. The relative portions of stream 30 and 33 are dependent on the LNG feed composition and the amount of ethane recovery required. A preferred split would be 2-10% in stream 30 and 90-98% in stream 33. The re-liquefied methane-rich (LNG) in stream 33 is directed to the main LNG export pumps (not shown) where the liquid will be pumped to pipeline pressures and eventually routed to the main LNG vaporizers.

As one knowledgeable in this area of technology, the particular design of the heat exchangers, pumps, compressors and separators is not critical to our invention. Indeed, it is a matter of routine engineering practice to select and size the specific unit operations to achieve the desired performance. Our invention lies with the unique combination of unit operations and the discovery of using untreated LNG as external reflux to achieve high levels of separation efficiency in order to recover NGL.

While we have described what we believe are the preferred embodiments of the invention, those knowledgeable in this area of technology will recognize that other and further modifications may be made thereto, e.g., to adapt the invention to various conditions, type of feeds, or other requirements, without departing from the spirit of our invention as defined by the following claims.

We claim:

1. A process of recovering hydrocarbons heavier than methane from liquefied natural gas (LNG) comprising, a) pumping liquid, low pressure LNG to a pressure of greater than 100 psia;

b) directing the pressurized liquid LNG from step a) to a cold box where it is heat exchanged to increase its temperature;

c) directing the heat exchanged pressurized liquid LNG from step b) to a separator where, in combination with a first and second reflux, a separator overhead is produced along with a separator bottoms;

d) pressurizing the separator bottoms and then splitting the pressurized separator bottoms into first and second portions;

e) directing the first portion of pressurized separator bottoms to a deethanizer as a reflux stream;

f) heating the second portion of pressurized separator bottoms by directing the second portion to the cold box;

g) directing the heated second portion of pressurized separator bottoms to the deethanizer;

h) removing hydrocarbons heavier than methane as deethanizer bottoms;

i) directing a deethanizer overhead as the second feed to the separator;

h) removing the separator overhead from the separator and compressing the separator overhead prior to introduction into the cold box and heat exchanging with the pressurized liquid LNG to produce a re-liquefied pressurized LNG; and i) separating a portion of the re-liquefied pressurized LNG for use as the first reflux.

2. The process of claim 1 further comprising providing an external refrigerant to the cold box.

3. The process of claim 2 further comprising providing a high pressure stream of LNG as the external refrigerant to the cold box.

* * * * *

UNITED STATES PATENT AND TRADEMARK OFFICE

CERTIFICATE OF CORRECTION

PATENT NO. : 7,475,566 B2
APPLICATION NO. : 11/188961
DATED : January 13, 2009
INVENTOR(S) : Scott Schroeder, Kenneth Reddick and Noureddine Belhateche It is certified that error appears in the above-identified patent and that said Letters Patent is hereby corrected as shown below:

On the Title Page
At Item (73) Assignee, delete "Howe-Barker Engineer, Ltd." and replace with
-- Howe-Baker Engineers, Ltd. --.

Signed and Sealed this

Seventeenth Day of March, 2009

JOHN DOLL
*Acting Director of the United States Patent and Trademark Office*